US008491367B2

(12) United States Patent
Ishida et al.

(10) Patent No.: US 8,491,367 B2
(45) Date of Patent: Jul. 23, 2013

(54) DRIVING APPARATUS FOR TRAVELING OBJECTS

(75) Inventors: Tetsuo Ishida, Tokyo (JP); Junichi Haraguchi, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 0 days.

(21) Appl. No.: 13/582,135

(22) PCT Filed: Mar. 11, 2011

(86) PCT No.: PCT/JP2011/055742

§ 371 (c)(1),
(2), (4) Date: Aug. 31, 2012

(87) PCT Pub. No.: WO2011/111813

PCT Pub. Date: Sep. 15, 2011

(65) Prior Publication Data

US 2012/0329539 A1 Dec. 27, 2012

(30) Foreign Application Priority Data

Mar. 12, 2010 (JP) ..... 2010-055600

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl.
USPC ..... 463/6; 273/236

(58) Field of Classification Search
USPC ..... 273/237; 463/6
See application file for complete search history.

(56) References Cited

U.S. PATENT DOCUMENTS 5,472,192 A * 12/1995 Eto ..... 463/6
5,954,584 A * 9/1999 Yagi ..... 463/60
6,019,369 A 2/2000 Nakagawa et al.

FOREIGN PATENT DOCUMENTS

| | | | |
|---|---|---|---|
| JP | 9-42910 | A | 2/1997 |
| JP | 9-44249 | A | 2/1997 |
| JP | 9-47573 | A | 2/1997 |
| JP | 9-203604 | A | 8/1997 |
| JP | 9-225138 | A | 9/1997 |

OTHER PUBLICATIONS

International Search Report for PCT/JP2011/055742 dated Apr. 26, 2012.

* cited by examiner

*Primary Examiner* — David L Lewis
*Assistant Examiner* — Reginald Renwick
(74) *Attorney, Agent, or Firm* — Sughrue Mion, PLLC

(57) ABSTRACT

Two detected objects are arranged at each of multiple traveling objects. A driving apparatus for traveling objects determines which detected object corresponds to which traveling object on the basis of position information on detected objects of multiple traveling objects. In this determination, the driving apparatus for traveling objects supplies a travel start instruction to each of the multiple traveling objects sequentially during a determination period for the determination, and identifies that two detected objects of which the position information has changed after supplying the travel start instruction corresponds to the traveling object that has moved in response to the travel start instruction.

8 Claims, 9 Drawing Sheets

DRIVING APPARATUS FOR TRAVELING OBJECTS

CROSS REFERENCE TO RELATED APPLICATIONS

This application is a National Stage of International Application No. PCT/JP2011/055742filed Mar. 11, 2011, claiming priority based on Japanese Patent Application No. 2010-055600filed Mar. 12, 2010, the contents of all of which are incorporated herein by reference in their entirety.

BACKGROUND OF THE INVENTION

1. Field of the Invention

The present invention relates to a driving apparatus for traveling objects that drives multiple traveling objects.

2. Background Art

An example of a driving apparatus for traveling objects is a horse racing apparatus. In a horse racing apparatus disclosed in Patent Document 1, model horses, on which model jockeys ride, are arranged on a tabular field. Below the field, a tabular platform is disposed so as to face the tabular field. Multiple traveling objects (self-propelled carriers) that can run on the platform are arranged between the field and the platform. A magnet is provided on the upper surface of each traveling object, whereas another magnet having the opposite polarity to that of the magnet on the traveling objects is provided at a position at the bottom surface of each model horse, the position corresponding to the magnet on the traveling object. Thus, each model horse moves following its corresponding traveling object.

In the horse racing apparatus disclosed in Patent Document 1, a light emitter is provided on the bottom surface of each traveling object. The light emitters are shot by multiple cameras, of which the number is predetermined, and the location data of the traveling objects can be generated from the shot images. Since multiple traveling objects exist, first, it is necessary to identify which light emitter corresponds to which traveling object. In the horse racing apparatus disclosed in Patent Document 1, light emitters on the traveling objects are controlled to sequentially (individually) light up, so that it is determined which traveling object corresponds to the lighting light emitter. More specifically, controlling means for detecting the position of each traveling object instructs all traveling objects to turn off the light emitters, and then instructs only the first traveling object to turn on its light emitter. The controlling means associates the position data of the light emitter obtained at this stage with the first traveling object. In other words, it is determined that the light emitter lighting at this stage corresponds to the first traveling object. Next, the controlling means instructs only the second traveling object to turn on its light emitter, and associates the position data of the light emitter obtained at this stage with the second traveling object. By repetition of this operation, the light emitter corresponding to each traveling object is determined.

Patent Document 1: JP-A-9-47573

SUMMARY OF THE INVENTION

However, such a determination process cannot be used if it is impossible to control individual lighting of the light emitters (detected objects) of traveling objects (i.e., if it is only possible to turn on and off lighting of the light emitters of traveling objects simultaneously or if the light emitters are maintained to be always active) or if it is impossible to detect the detected objects individually (exclusively) (i.e., if it is impossible to select a detected object which is used for detection of the position from among the detected objects provided on all traveling objects, for example, if the detected objects are metal pieces). Accordingly, it is difficult to identify which detected object corresponds to which traveling object.

Accordingly, the present invention is made for solving a problem for providing a driving apparatus for traveling objects that can identify which detected object corresponds to which traveling object even if the detected objects provided on each traveling object cannot be detected individually.

In order to solve the above problem, the present invention uses solutions described below.

The present invention provides a driving apparatus for traveling objects for causing multiple traveling objects to travel on a traveling surface, including: a traveling controller adapted for controlling travel of each of the multiple traveling objects, two detected objects provided to each traveling object, the two detected objects spaced apart from each other by a predetermined interval on the corresponding traveling object; a position information outputter adapted for outputting position information on each of the multiple detected objects on the traveling surface; and a determiner adapted for identifying two detected objects corresponding to each of the multiple traveling objects on the basis of the position information on each of the multiple detected objects output from the position information outputter, in which the traveling controller is adapted for supplying a travel start instruction to each of the multiple traveling objects sequentially during a determination period for determining two detected objects corresponding to a traveling object, in which the determiner is adapted for conducting a comparison process whenever the traveling controller supplies the travel start instruction, in the comparison process, the determiner is adapted for comparing the position information of each detected object output from the position information outputter before supplying the travel start instruction with the position information of each detected object output from the position information outputter after supplying the travel start instruction, and in which the determiner is adapted for identifying two detected objects of which the position information has changed as the two detected objects corresponding to the traveling object that has moved in response to the travel start instruction.

In the present invention, whenever the traveling controller supplies the travel start instruction, the determiner conducts a comparison process for comparing the position information of each detected object output from the position information outputter before supplying the travel start instruction with the position information of each detected object output from the position information outputter after supplying the travel start instruction, and identifies two detected objects of which the position information has changed as the two detected objects corresponding to the traveling object that has moved in response to the travel start instruction. Therefore, even if information on the position of each detected object cannot be obtained individually, it is possible to determine accurately and easily two detected objects corresponding to each traveling object.

Preferably, the determiner is adapted for identifying two detected objects of which the position information has changed as the two detected objects corresponding to the traveling object that has moved in response to the travel start instruction when one of, or a combination of any of a first determination, a second determination, and a third determination is affirmative, in which in the first determination, the determiner is adapted for determining whether or not the position information on two detected objects has changed, in which in the second determination, the determiner is adapted for determining whether or not the vectors of traveling directions of the two detected objects of which the position information has changed are the same as each other, and in which in the third determination, the determiner is adapted for determining whether or not an interval between the two detected objects of which the position information has changed is the same as the predetermined interval.

In this case, it is possible to determine more accurately two detected objects corresponding to the traveling object that has moved in response to the travel start instruction. It is possible to use a result of a determination process into which another determination process is incorporated.

In an embodiment of the driving apparatus for traveling objects according to the present invention, the determiner is adapted for identifying two detected objects that have not been determined to correspond to which traveling object and of which the position information has changed as the two detected objects corresponding to the traveling object that has moved in response to the travel start instruction.

In this embodiment, it is also possible to determine two detected objects corresponding to a next traveling object by supplying the travel start instruction to the next traveling object, whereas the traveling object of which the corresponding two detected objects have been determined is maintained to travel. For example, let us assume that the travel start instruction is supplied to a second traveling object, whereas after two detected objects corresponding to a first traveling object that has traveled in response to a first travel start instruction have been determined, the first traveling object is maintained to travel. In this case, if the position information on each detected object output from the position information outputter after the travel start instruction is supplied to the second traveling object is compared with the position information on each detected object output from the position information outputter directly before the travel start instruction is supplied to the second traveling object, the number of detected objects of which the position information has changed is four since the first traveling object continually travels. However, it has already been determined that two among the four detected objects correspond to the first traveling object, and the remaining two detected objects match the "two detected objects that have not been determined to correspond to which traveling object and of which the position information has changed" and can be determined to be two detected objects corresponding to the second traveling object.

The number of detected objects provided to each of the multiple traveling objects may be one. More specifically, the driving apparatus for traveling objects according to the present invention may be a driving apparatus for traveling objects for causing multiple traveling objects to travel on a traveling surface, including: a traveling controller adapted for controlling travel of each of the multiple traveling objects, a detected object provided to each traveling object; a position information outputter adapted for outputting position information on each of the multiple detected objects on the traveling surface; and a determiner adapted for identifying a detected object corresponding to each of the multiple traveling objects on the basis of the position information on each of the multiple detected objects output from the position information outputter, in which the traveling controller is adapted for supplying a travel start instruction to each of the multiple traveling objects sequentially during a determination period for determining a detected object corresponding to a traveling object, in which the determiner is adapted for conducting a comparison process whenever the traveling controller supplies the travel start instruction, in the comparison process, the determiner is adapted for comparing the position information of each detected object output from the position information outputter before supplying the travel start instruction with the position information of each detected object output from the position information outputter after supplying the travel start instruction, and in which the determiner is adapted for identifying a detected object of which the position information has changed as the detected object corresponding to the traveling object that has moved in response to the travel start instruction.

Preferably, an embodiment of the driving apparatus for traveling objects may include a tracker adapted for tracking position information of one or two detected objects corresponding to each of the multiple traveling objects identified by the determiner. In this case, it is possible to track the position information on each traveling object.

The position information outputter of the driving apparatus for traveling objects may have any structure as long as it can output the position information of each of the detected objects. For example, the detected objects may be made of an electric conductor. Multiple driving lines and multiple detected lines may be arranged to perpendicularly intersect one another on the traveling surface, electromagnetic couplings being made at intersections of the multiple driving lines and multiple detected lines. The position information outputter may supply a driving current to each of the multiple driving lines sequentially, and may obtain the position information of each detected object on the basis of a value of an induced current flowing each of the detected lines. In this embodiment, the position information outputter simultaneously obtains the position information of each detected object on the traveling surface by scanning the traveling surface at predetermined intervals, but cannot output the position information of each detected object individually. However, as described above, whenever the traveling controller outputs the travel start instruction, the determiner conducts the comparison process for comparing the position information of each detected object output from the position information outputter before supplying the travel start instruction with the position information of each detected object output from the position information outputter after supplying the travel start instruction, and identifies two detected objects of which the position information has changed as the two detected objects corresponding to the traveling object that has moved in response to the travel start instruction. Therefore, even in this embodiment, it is possible to determine which two detected objects correspond to which traveling object accurately.

The present invention may also be understood as a method for determining two detected objects corresponding to each of multiple traveling objects. According to the present invention, there is provided a method for determining two detected objects corresponding to each of multiple traveling objects on the basis of position information on each of the multiple detected objects, the method being used in a driving apparatus adapted for causing the multiple traveling objects to travel on a traveling surface, two detected objects spaced apart from each other by a predetermined interval provided to each traveling object, the method including: supplying a travel start instruction to each of the multiple traveling objects sequentially during a determination period for determining two detected objects corresponding to a traveling object; comparing the position information of each detected object before supplying the travel start instruction with the position information of each detected object after supplying the travel start instruction whenever travel start instruction is supplied; and identifying two detected objects of which the position information has changed as the two detected objects corresponding to the traveling object that has moved in response to the travel start instruction. The method can achieve effects that are the same as those achieved by the driving apparatus for traveling objects according to the present invention.

The present invention may also be understood to be an invention of a program. The program is incorporated into a driving apparatus adapted for causing multiple traveling objects to travel on a traveling surface, two detected objects spaced apart from each other by a predetermined interval provided to each traveling object. The program causes the driving apparatus to conduct: supplying a travel start instruction to each of the multiple traveling objects sequentially during a determination period for determining two detected objects corresponding to a traveling object; comparing position information of each detected object on the traveling surface before supplying the travel start instruction with position information of each detected object on the traveling surface after supplying the travel start instruction whenever travel start instruction is supplied; and identifying two detected objects of which the position information has changed as the two detected objects corresponding to the traveling object that has moved in response to the travel start instruction.

DESCRIPTION OF EMBODIMENTS

With reference to the accompanying drawings, an embodiment according to the present invention will be described.

1. Entire Game Apparatus

Figure 1:
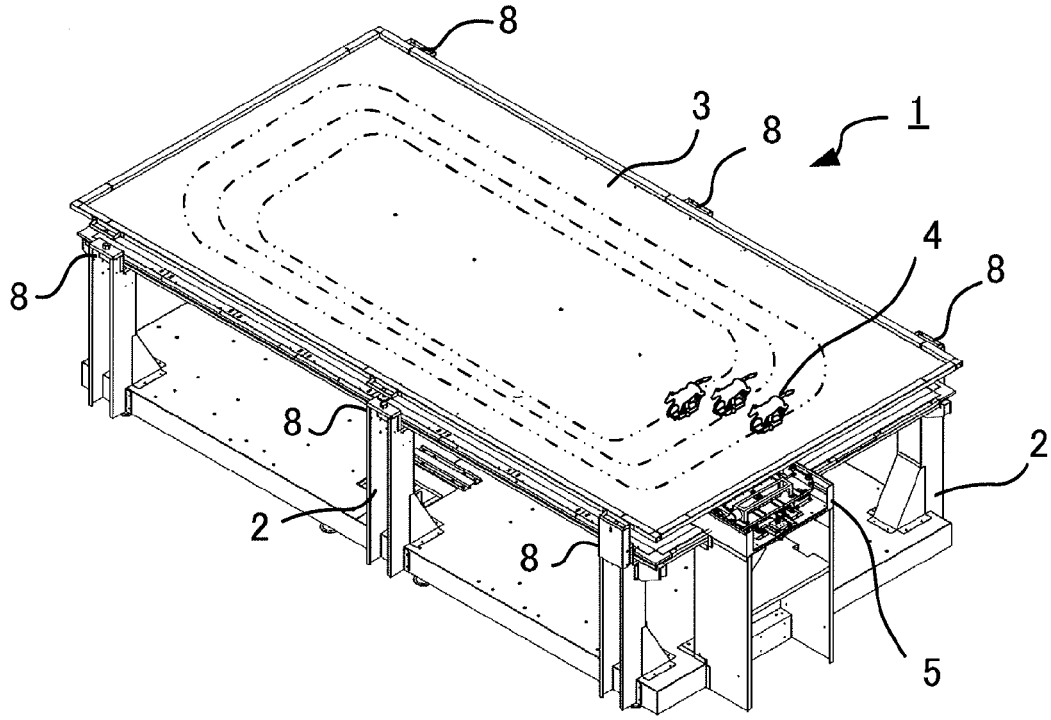
FIG. 1 is a perspective view showing a game apparatus according to an embodiment of the present invention.

As shown in FIG. 1, a driving apparatus for traveling objects (game apparatus) 1 according to the embodiment of the present invention includes multiple columns 2, a floor panel 3 supported horizontally by the columns 2, and multiple (three in the illustrated embodiment) model horses 4 that run on the floor panel 3. Although not shown in FIG. 1, each of the model horses 4 travels on the floor panel 3 by the pulling activity of a magnetic force exerted by a self-propelled carrier (traveling object) arranged below the floor panel 3. In the game apparatus 1, a horse racing game is executed. In the horse racing game apparatus, as depicted by imaginary lines in FIG. 1, each model horse 4 runs so as to describe an oval or a substantially quadrangular orbit. Although not shown, model horses 4 may be driven to run so as to describe lines that intersect one another.

Figure 2:
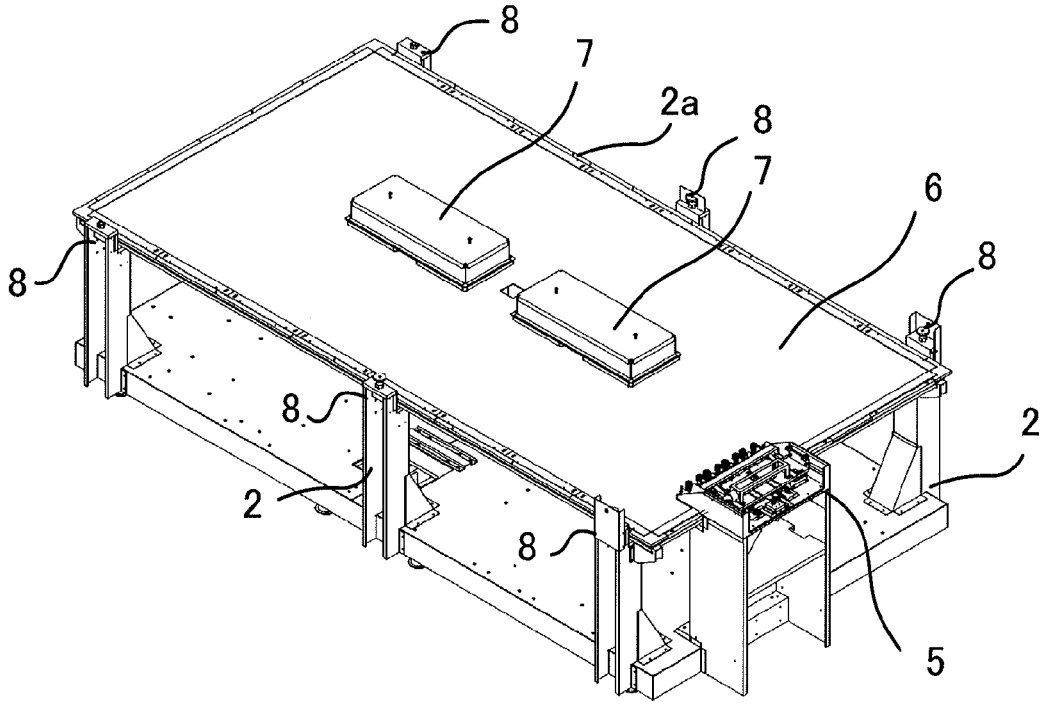
FIG. 2 is a perspective view showing the game apparatus, from which a floor panel and model horses are removed.

FIG. 2 is a perspective view showing the game apparatus 1, from which the floor panel 3 and the model horses 4 are removed. A second floor panel 6 is supported horizontally by a frame 2*a* fixed to the column 2. On the frame 2*a*, an electric charging apparatus for charging the traveling objects are mounted. Two cuboid blocks 7 are placed on the second floor panel 6. The floor panel 3 is supported by multiple brackets 8 at the top ends of the columns 2 and the blocks 7.

Figure 3:
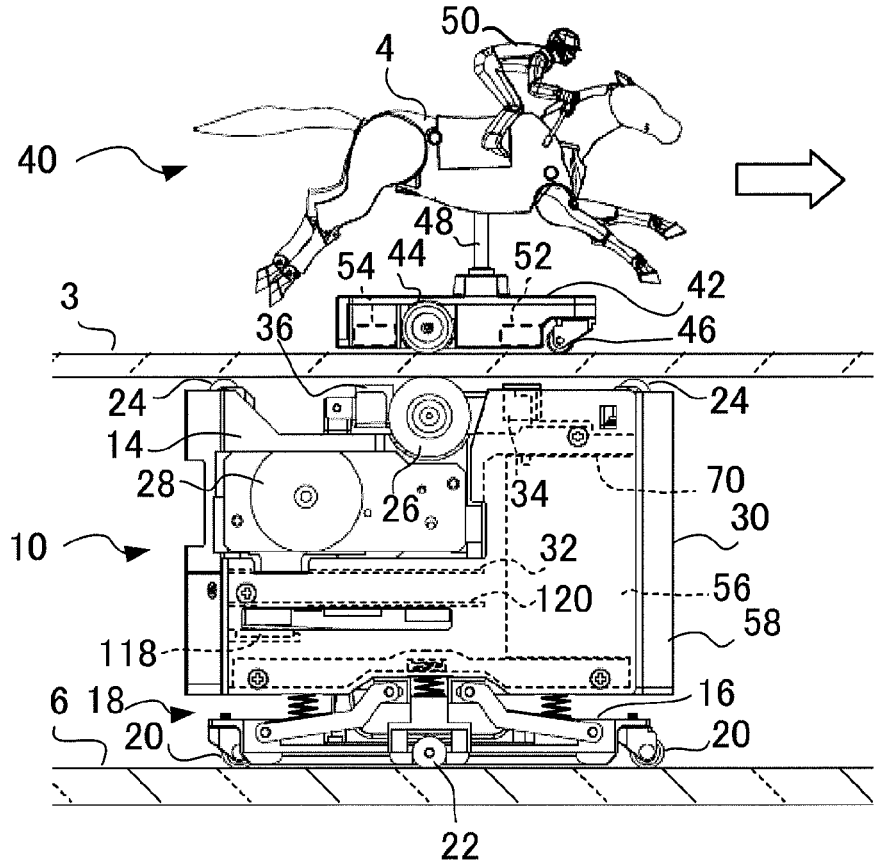
FIG. 3 is a front view showing a model horse and a traveling object used in the game apparatus.

As shown in FIG. 3, traveling objects 10 are arranged in the space between the floor panel 3 and the second floor panel 6. In the game apparatus 1 of the embodiment, there are three traveling objects 10 corresponding to the three model horses 4 and two traveling objects 10 corresponding to a start gate (not shown) for the model horses 4. However, only one traveling object 10 corresponding to a single model horse 4 is shown in FIG. 3 to simplify description.

Figure 4:
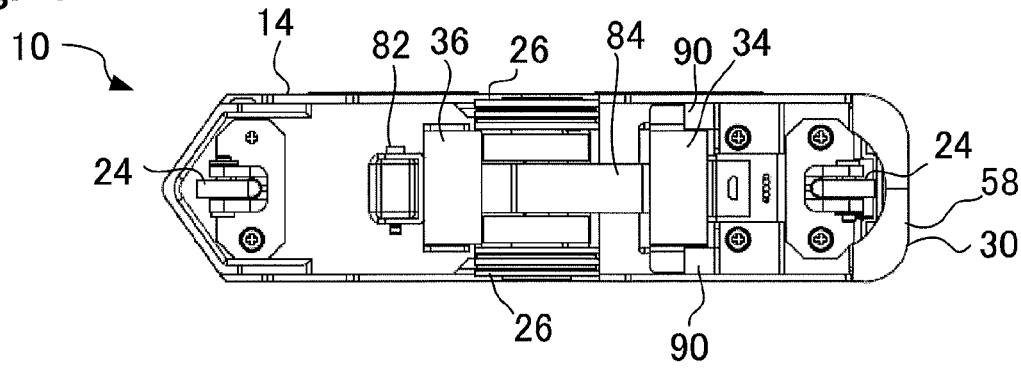
FIG. 4 is a plan view showing the traveling object.
Figure 5:
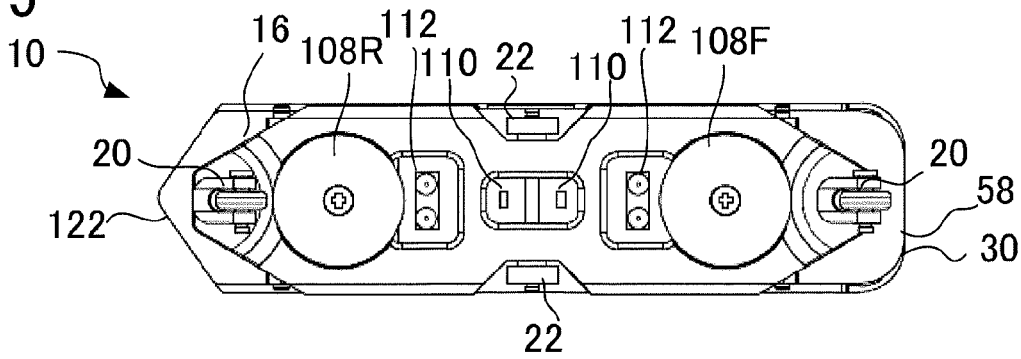
FIG. 5 is a bottom view showing the traveling object.

With reference to FIGS. 3 through 5, details of the traveling object 10 will be described. The runnable traveling object 10 includes an upper part 14, a lower part 16, and an electric power source assembly 30. The upper part 14 and the lower part 16 are connected via a suspension 18. As best shown in the bottom view of FIG. 5, a pair of casters 20 is attached to each of the two ends of the lower part 16 in the longitudinal direction, whereas a pair of wheels 22 is attached to each of the two ends of the lower part 16 in the transverse direction. By the activities of the casters 20 and the wheels 22, the traveling object 10 can run on the second floor panel 6.

As best shown in the plan view of FIG. 4, a pair of casters 24 is attached to each of the two ends of the upper part 14 in the longitudinal direction, whereas a pair of driving wheels 26 is attached to each of the two ends of the upper part 14 in the transverse direction. The driving wheels 26 are rotated respectively by different wheel motors 28 fixed to the upper part 14. The rotation of the wheel motor 28 is transmitted to the driving wheel 26 corresponding to the wheel motor 28 via a gear train (not shown). Instead of the gear train, it is possible to use another suitable driving force transmission mechanism, for example, a belt-pulley mechanism or a chain-sprocket mechanism.

As shown in FIG. 3, the upper part 14 of the traveling object 10 holds an electric power source assembly 30 within which at least one rechargeable power-supply device is situated. A driving circuit board 32 is fixed within the upper part 14, whereas a driving circuit 150 is formed on the driving circuit board 32. Receiving electricity from the power-supply device in the electric power source assembly 30, the driving circuit 150 drives the wheel motors 28 to rotate the driving wheels 26.

By the magnetic force exerted between model pullers 34 and 36 and pulled sections 52 and 54 of the model assembly 40 (which will be described later), the entire traveling object 10 is pulled upward, i.e., toward the floor panel 3. As a result, the wheels of the casters 24 and the driving wheels 26 are in contact with the upper floor panel 3. When the driving wheels 26 rotate, by the friction contact between the driving wheels 26 and the floor panel 3, the traveling object 10 travels in the direction depicted by the arrow in FIG. 3. Thus, the wheel motors 28 and the driving wheels 26 constitute a traveling mechanism that can travel by the electric power source assembly 30. However, instead of the driving wheels 26, it is possible to use other suitable traveling means, for example, caterpillars, arms with link mechanisms, or legs with link mechanisms.

Since different wheel motors 28 rotate both driving wheels 26, respectively, it is possible to rotate both driving wheels 26 at different rotational speed, and to turn the advancing direction of the traveling object 10 by the difference in speed of the driving wheels 26. The casters 20 and 24 facilitate the change in direction of the traveling object 10. The shaft of each wheel motor 28 can rotate in both directions, so that the traveling object 10 can move forward and rearward. When both driving wheels 26 are rotated in opposite directions, the traveling object 10 can pivot about a vertical axis on the spot.

A model assembly 40 is disposed on the floor panel 3. The model assembly 40 includes a carriage 42, a pair of wheels 44 rotatably attached to the carriage 42, a caster 46 rotatably attached to the carriage 42, a mast 48 standing on the pole carriage 42, and a model horse 4 mounted on the mast 48. A model jockey 50 is mounted on the model horse 4. Inside the carriage 42, two pulled sections 52 and 54 are arranged. The pulled sections 52 and 54 are ferromagnets or magnets, preferably, permanent magnets.

On the other hand, model pullers 34 and 36 are mounted on the upper part 14 of the traveling object 10. The model pullers 34 and 36 are ferromagnets or magnet, preferably, permanent magnets. The floor panel 3 is made of a non-magnetic material, so that the model puller 34 of the traveling objects 10 and the pulled section 52 of the model assembly 40 pull each other by magnetic force, and the model puller 36 of the traveling objects 10 and the pulled section 54 of the model assembly 40 pull each other by magnetic force. Therefore, when the traveling object 10 runs, the model pullers 34 and 36 pull the model assembly 40 so that the model assembly 40 travels together with the traveling object 10. In a preferred embodiment, the model pullers 34 and 36 and the pulled sections 52 and 54 are permanent magnets, but other options may be used.

As has been described above, the traveling objects 10 runs under the floor panel 3, whereas the model assembly 40 corresponding to the traveling object 10 pulled by the traveling objects 10 runs on the floor panel 3 as depicted by the arrow in FIG. 3. In the embodiment, the direction of the arrow in FIG. 3 is the advancing direction of the traveling object 10, the direction opposite to the arrow in FIG. 3 is the rearward movement direction of the traveling object 10.

2. Control System Of Game Apparatus

Next, with reference to FIG. 6, the outline of a control system of the game apparatus will be described. The control system of the game apparatus includes an overall control device 100 (traveling controller), a position information outputter 102, a first light emitting device 104, and a second light emitting device 106. The overall control device 100 is a computer that controls the overall game apparatus including the multiple traveling objects 10 and the electric charging apparatus 5. In the illustrated embodiment, a single overall control device 100 is used, but it is possible to separately provide a control device for receiving signals from the position information outputter 102 and for controlling the first light emitting device 104 and the second light emitting device 106, and another control device for receiving signals from the electric charging apparatus 5 and for controlling the electric charging apparatus 5.

The first light emitting device 104 emits light (e.g., visible light) within a wavelength region in order to activate all of the traveling objects 10 simultaneously. In accordance with a computer program, the overall control device 100 causes the first light emitting device 104 to emit the light.

After activation of the traveling objects 10, the second light emitting device 106 sends traveling control signals for controlling the travel of each traveling object 10 by means of emitting light (e.g., infrared light) within a wavelength region which is different from that of the light emitted by the first light emitting device 104. In accordance with the computer program, the overall control device 100 supplies traveling control signals for controlling the multiple traveling objects 10 to the second light emitting device 106, and the second light emitting device 106 emits the light in accordance with the traveling control signals. An identifier for identifying the traveling object 10 to be controlled is attached to each traveling control signal, so that each traveling object 10 can recognize the traveling control signal that is destined for the traveling object 10 itself. Instead of the light emitting devices 104 and 106, communication devices that use other wireless communication schemes using other radiowaves may be utilized.

Preferably, the second floor panel 6 (FIGS. 1 through 3) with high optical transparency may be used, whereas the first light emitting device 104 and the second light emitting device 106 may be located beneath the second floor panel 6. However, if the optical transparency of the second floor panel 6 is low, the first light emitting device 104 and the second light emitting device 106 may be located between the floor panel 3 and the second floor panel 6.

As shown in the bottom view of FIG. 5, two the first optical sensors 110 and two second optical sensors 112 are exposed at the bottom surface of the lower part 16 of the traveling object 10. The first optical sensors 110 are, for example, visible light sensors, which output a light-reception signal upon receiving the light emitted from the first light emitting device 104. The second optical sensors 112 are, for example, infrared sensors, which output traveling control signals transmitted by the light emitted from the second light emitting device 106. In the illustrated embodiment, two first optical sensors 110 and two second optical sensors 112 are provided in order to ensure that if there is drawback to arrival of light to a sensor of each pair, the remaining sensor can receive light. However, a single first optical sensor 110 and a single second optical sensor 112 may be provided. At least three first optical sensors 110 and at least three second optical sensor 112 may also be provided.

Figure 6:
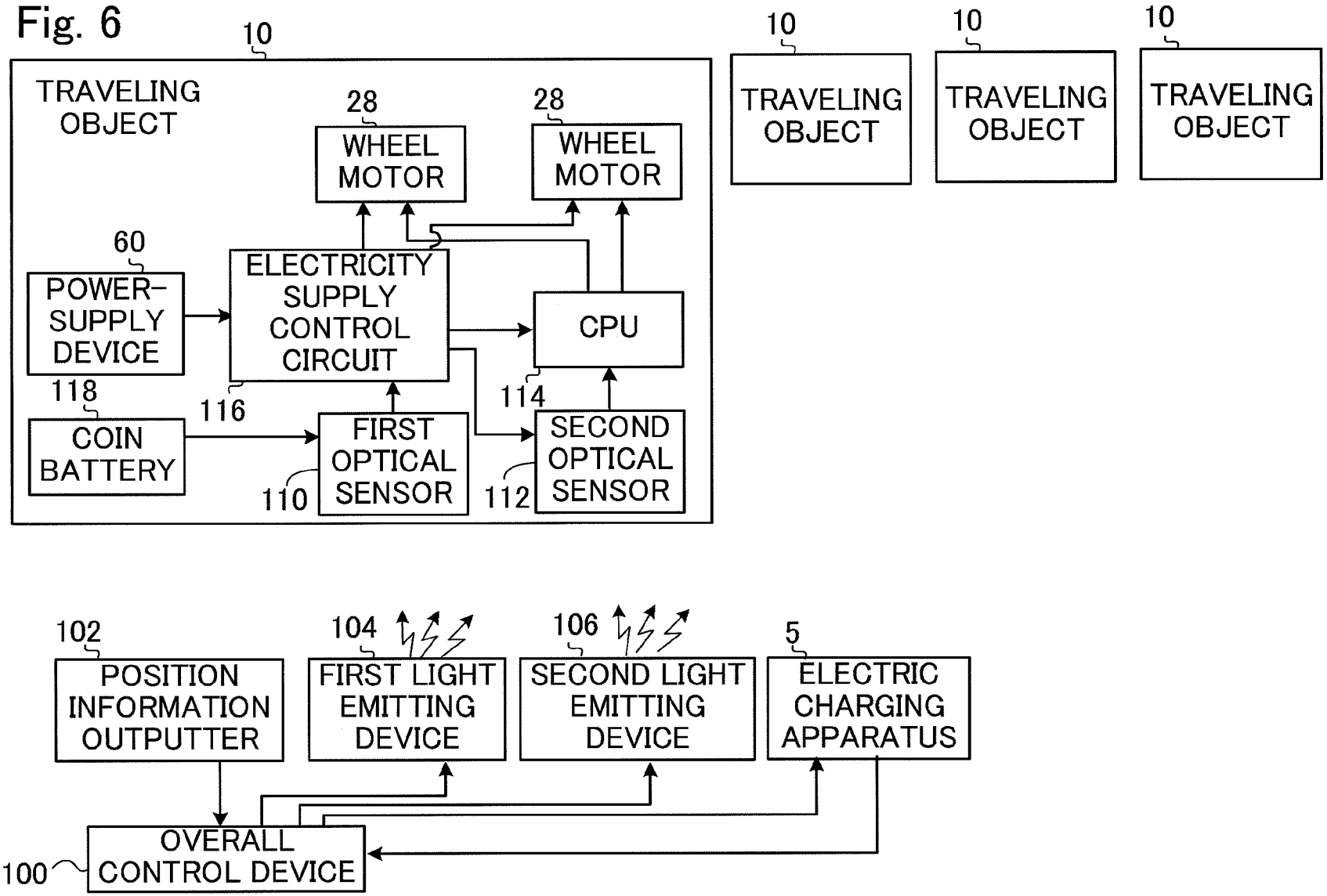
FIG. 6 is a block diagram showing an outline of a control system in the game apparatus.

As shown in FIG. 6, each traveling object 10 further includes a CPU (central processing unit) 114, an electricity supply control circuit 116, and a coin battery 118. The CPU 114 is mounted on the driving circuit board 32 shown in FIG. 3, whereas the electricity supply control circuit 116 is mounted on an electricity supply control circuit board 120 shown in FIG. 3. The coin battery 118 is attachable to and detachable from the traveling object 10. The coin battery 118 always supplies electricity to the first optical sensor 110 so that the first optical sensor 110 can output the light-reception signal. Upon receiving the light-reception signal from the first optical sensor 110 caused by the light emission of the first light emitting device 104, the electricity supply control circuit 116 enables electric supply from a power-supply device 60 in the electric power source assembly 30 to the CPU 114, the second optical sensor 112, and both wheel motors 28.

After start of the electric supply from the power-supply device 60 to these elements, the second optical sensor 112 transmits traveling control signals sent from the second light emitting device 106 to the CPUs 114 of the traveling objects 10. The CPU 114 of each traveling object 10 selects a traveling control signal for the traveling object 10 to which the CPU 114 belongs from among traveling control signals for multiple traveling objects 10, and controls both wheel motors 28 in accordance with the traveling control signal.

The traveling control signal indicates the rotational speed or rotational angle for each of wheel motors 28. As a result, for each traveling object 10, the rotational speed of each of driving wheels 26 is controlled. If the rotational speeds of both driving wheels 26 are the same, the traveling object 10 travels in a straight line. Otherwise, the traveling object 10 travels in a curved line.

Next, with reference to FIG. 7, the position information outputter 102 will be described. In this embodiment, the surface of the second floor panel 6 (surface on which the traveling object 10 travels) is covered with a position detective sheet Lds, which is a sheeted member. On the surface of the position detective sheet Lds (the surface opposite to the surface with which the second floor panel 6 is contact), m driving coils 130 (driving lines) extending in the X direction and n detected coils 132 (detected lines) extending in the Y direction, orthogonal to the X direction, are formed. In this embodiment, the number m of the driving coils 130 is 150, whereas the number n of the detected coils 132 is 300. The interval between neighboring driving coils 130 and the interval between neighboring detected coils 132 are set to 10 mm. However, these values may be set freely. From the point of view of the vertical plane to FIG. 7, parallel parts of the detected coils 132 are orthogonal to parallel parts of the driving coils 130. However, although not shown, the layer in which the detected coils 132 are placed is different from the layer in which the driving coils 130 are placed. These layers are arranged in parallel, and there is another layer of a non-conductive material between these layers.

Electromagnetic couplings are made at intersections of the multiple driving coils 130 and multiple detected coils 132. In this embodiment, the intersections of the detected coils 132 and the driving coils 130 are referred to as cells P. Consequently, on the surface of the position detective sheet Lds, multiple cells P are arranged in a matrix of m rows and n columns. Although detailed illustration is omitted, the surface of the position detective sheet Lds on which the multiple cells P are formed in a matrix is covered with a transparent acrylic plate. The traveling objects 10 travel on the acrylic plate.

Figure 7:
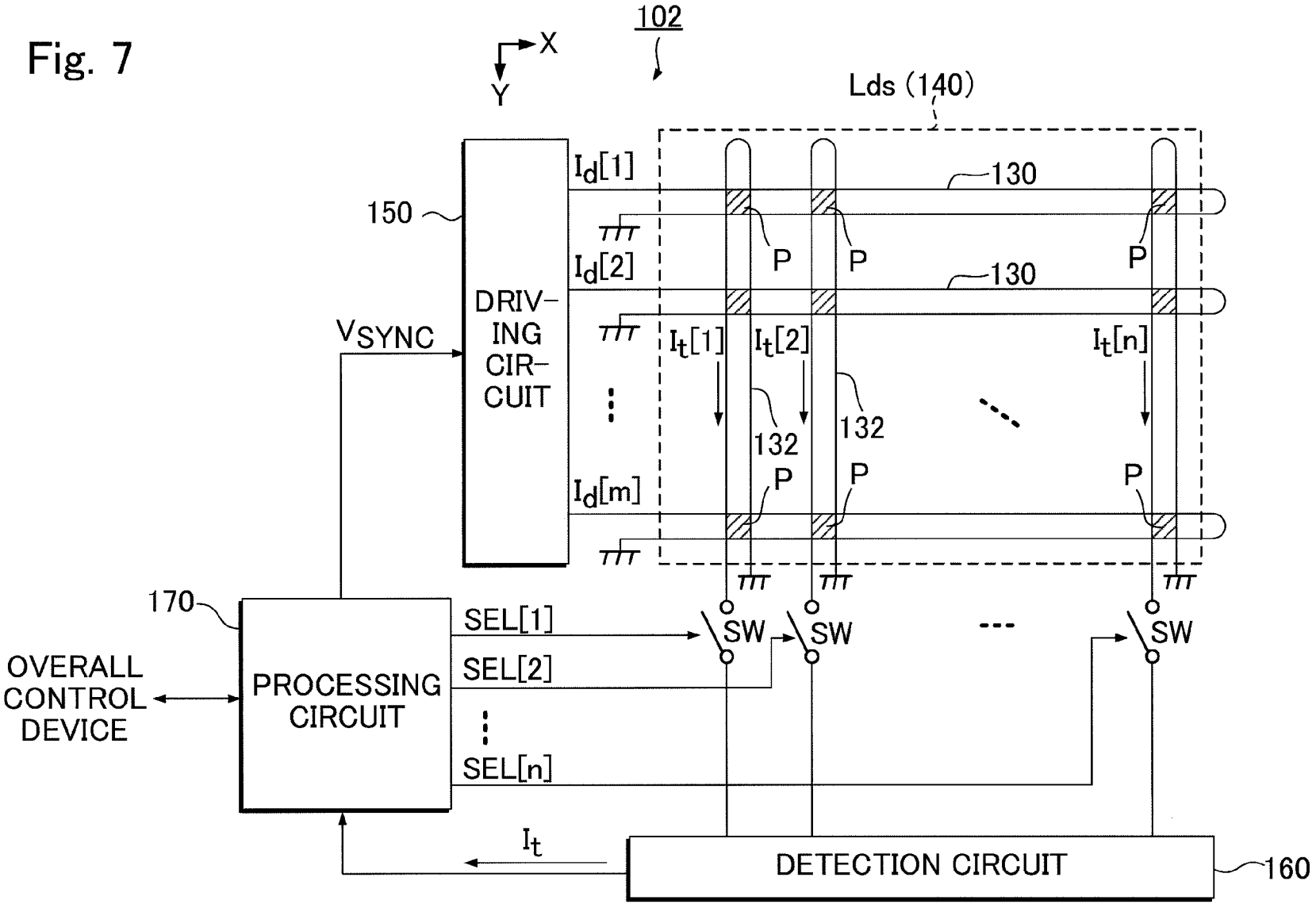
FIG. 7 is a block diagram showing an outline of a position information outputter in the game apparatus.

As shown in FIG. 7, the position information outputter 102 includes a cell part 140 on which the multiple cells P are deployed, the aforementioned driving circuit 150, a detection circuit 160, and a processing circuit 170 for controlling overall operations of the entire position information outputter 102 and for executing various processes. On the basis of timing signals $V_{SYNC}$ supplied from the processing circuit 170, the driving circuit 150 sequentially supplies a driving current $I_d$ to each of the multiple driving coils 130. For convenience of description, the driving current supplied to the driving coil 130 of the i-th row ($1 \leqq i \leqq m$) is referred to as $I_d[i]$. When a driving current $I_d[i]$ is supplied to the driving coil 130 of the i-th row, because of mutual induction, an induced electromotive force is generated at n cells P placed at the intersections of this driving coil 130 of the i-th row and the n detected coils 132, whereby induced currents $I_t$ ($I_t[1]$ to $I_t[n]$) flow through n detected coils 132. For convenience of description, the induced current flowing through the detected coil 132 of the j-th column ($1 \leqq j \leqq n$) is referred to as $I_t[j]$.

As shown in FIG. 5, a pair of discoid detected pieces 108 (108F and 108R) made of an electric conductor are fixed to the bottom surface of the lower part 16 of the traveling objects 10 in such a manner that the centers of the detected pieces 108F and 108R are spaced apart from each other by a predetermined interval. Among the pair of detected pieces (detected objects) 108, the detected piece 108 at the side of the advancing direction of the traveling objects 10 is referred to as detected piece 108F, whereas the detected piece 108 at the side of the rearward movement direction of the traveling objects 10 is referred to as detected piece 108R. When one of the two detected pieces 108 of a traveling object 10 is located on the position corresponding to a cell P[i, j] on the intersection of the driving coils 130 of the i-th row and the detected coil 132 of the j-th column, change in magnetic flux flowing through the cell P [i, j] increases in comparison with the case in which the detected piece 108 is not located on the position corresponding to the cell P[i, j]. Therefore, the value of the induced current $I_t[j]$ in this case is greater than that when the detected piece 108 is not located on the position corresponding to the cell P[i, j].

Figure 8:
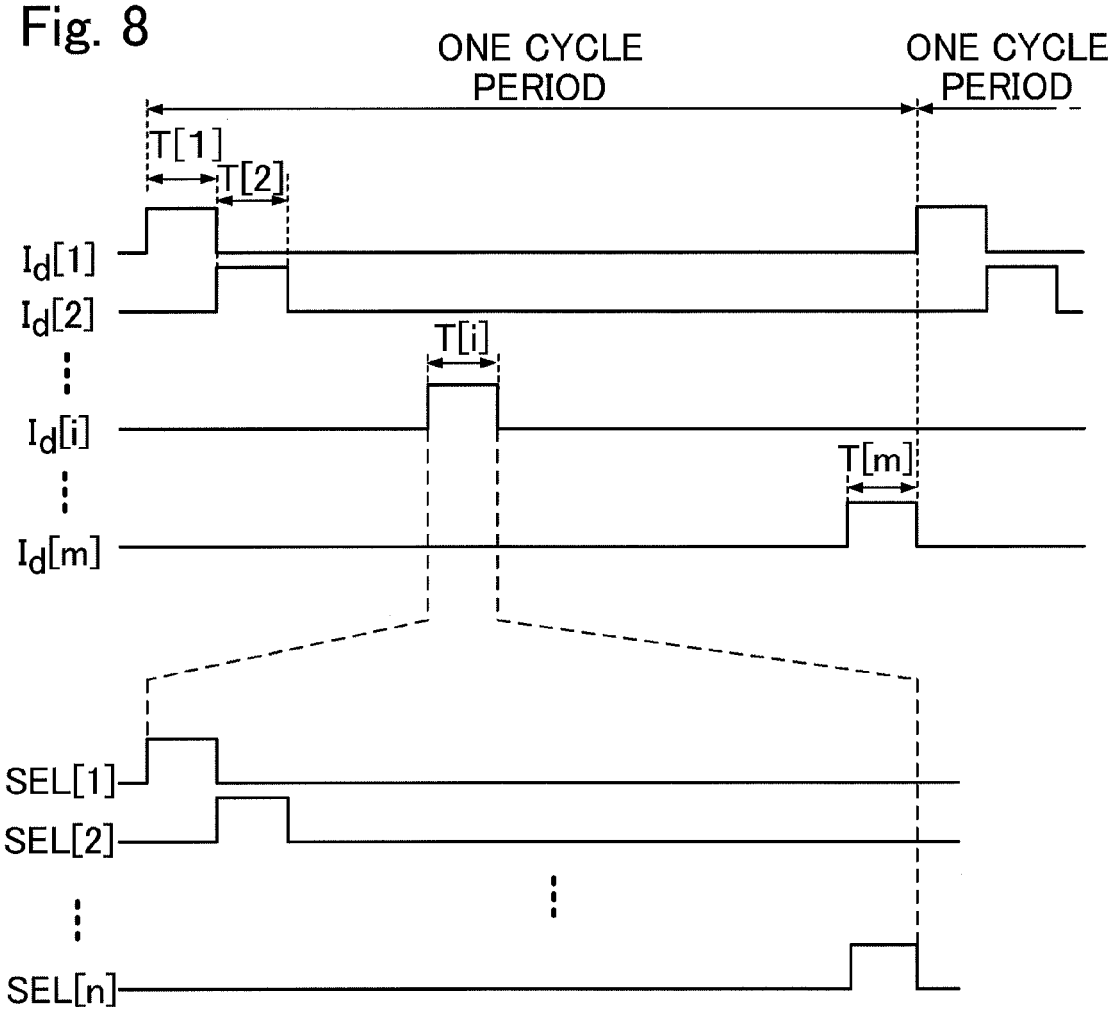
FIG. 8 is a time chart showing specific operations of the position information outputter in the game apparatus.

FIG. 8 is a time chart showing specific operations of the position information outputter 102. The driving circuit 150 supplies the driving currents $I_d[1]$ to $I_d[m]$ sequentially to the driving coils 130 at each of unit periods T (T[1] to T[m]) within a cycle period. In this embodiment, one cycle period is set to ten milliseconds. In FIG. 8, the fact that the driving current $I_d[i]$ is at the higher level means that the driving current $I_d[i]$ is supplied to the driving coil 130 of the i-th row, whereas the fact that the driving current $I_d[i]$ is at the lower level means that the driving current $I_d[i]$ is stopped to be supplied to the driving coil 130 of the i-th row. As shown in FIG. 8, at the i-th unit period T[i], driving current $I_d[i]$ for the driving coil 130 of the i-th row is set to be the higher level.

As shown in FIG. 7, a switch SW is interposed between each of n detected coils 132 and the detection circuit 160. In the embodiment, the switch SW is made of an n-channel transistor. Each of n switches SW is activated when an operational signal SEL supplied from the processing circuit 170 transits to the active level (the higher level). For convenience of description, the operational signal SEL supplied to the switch SW corresponding to the detected coil 132 of the j-th column is referred to as the switch SEL[j]. As shown in FIG. 8, at each of unit periods T (T[1] to T[m]), the operational signals SEL[1] to SEL[n] transit to the active level sequentially. In FIG. 8, let us pay attention to the i-th unit period T[i]. It will be understood that the operational signals SEL[1] to SEL[n] change to the higher level sequentially at the unit period T[i]. Since each of n switches are activated sequentially at the unit period T[i], the induced currents $I_t[1]$ to $I_t[n]$ each having an analog value flowing through the detected coils 132 are output to the detection circuit 160 via the switches SW at the unit period T[i]. The detection circuit 160 amplifies the induced currents $I_t[1]$ to $I_t[n]$ by means of an amplifier (not shown) therein, and outputs the amplified induced currents to the processing circuit 170.

Figure 9:
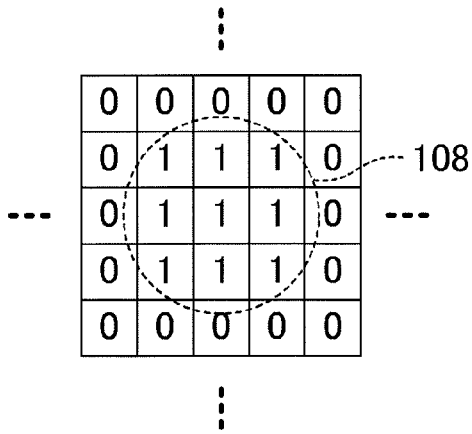
FIG. 9 is a diagram for describing sensing data.

On the basis of the induced currents $I_t$ output sequentially from the detection circuit 160, the processing circuit 170 generates sensing data of each cycle period. More specifically, the processing circuit 170 converts the induced currents output from the detection circuit 160 to binary detection values d (digital values) sequentially, and classifies the detection values d according to cycle periods for generating the sensing data. In other words, the sensing data for one cycle period is a group of detection values of which the number is the multiplication of m by n. In this embodiment, the processing circuit 170 converts the induced current $I_t$ exceeding a predetermined threshold to the detection value d of one, and converts the induced current $I_t$ not exceeding the predetermined threshold to the detection value d of zero. Consequently, as shown in FIG. 9, detection values on the cells P corresponding to the position of the detected piece 108 are one, whereas detection values on the cells P corresponding to the position on which the detected piece 108 is not located are zero. In the coordinate system of this embodiment, ten numbers are assigned to the width of each coil, so that the x-coordinate may be one among 0 to 2999 whereas the y-coordinate may be one among 0 to 1499, and x and y coordinates are given to each detection value d constituting the sensing data. On the basis of the sensing data for each cycle period, the processing circuit 170 calculates the coordinates of the center of each individual detected piece 108 (central coordinates of each detected pieces 108) at each cycle period. Thus, the processing circuit 170 obtains position information on each of the detected pieces 108 (information indicating the position of each detected piece 108 on the second floor panel 6) at each cycle period. The processing circuit 170 outputs the thus obtained position information of each detected piece 108 to the overall control device 100. The overall control device 100 stores into the memory (not shown) the position information of each detected piece 108 at each cycle period supplied from the processing circuit 170.

3. Determination Process

On the basis of the position information of each detected piece 108 output from the position information outputter 102, the overall control device 100 executes a determination process for identifying two detected pieces 108 corresponding to each of the multiple traveling objects 10. More specifically, the overall control device 100 supplies a travel start instruction to each of the multiple traveling objects 10 sequentially during a determination period for determining two detected objects corresponding to a traveling object 10. The determination period may be set at an initializing process executed whenever the power source is applied to the game apparatus 1. Alternatively, it may be set at the initializing process executed when the power source is first applied to the game apparatus 1 after installation of the game apparatus 1 at the game facility before the determination process is executed. Alternatively, it may be set at an optional timing by manipulation of the management staff of the game facility. The overall control device 100 conducts a comparison process whenever supplying the travel start instruction. In the comparison process, the overall control device 100 compares the position information of each detected object output from the position information outputter 102 before supplying the travel start instruction with the position information of each detected object output from the position information outputter 102 after supplying the travel start instruction. The overall control device 100 identifies two detected pieces 108 of which the position information has changed as the two detected pieces 108 corresponding to the traveling object 10 that has moved in response to the travel start instruction. Details of the determination process will be described hereinafter.

Figure 10:
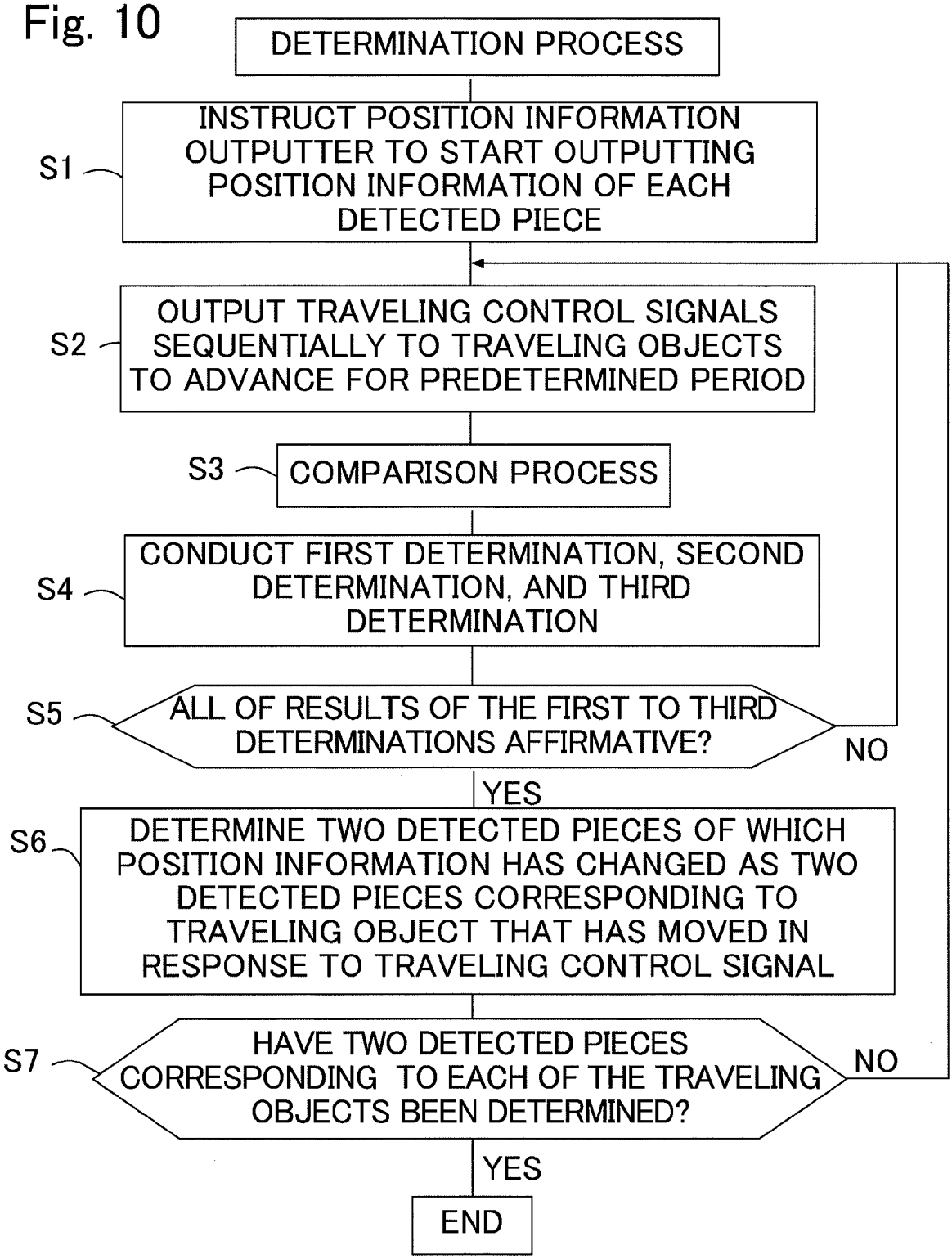
FIG. 10 is a flowchart showing details of a determination process executed in the game apparatus.

FIG. 10 a flowchart showing details of the determination process executed by the overall control device 100 in the determination period. As shown in FIG. 10, the overall control device 100 first instructs the position information outputter 102 to start outputting the position information of each detected piece 108 (step S1). This step includes various settings for the position information outputter 102. In a period (referred to as a preparation period) starting at the time point at which the overall control device 100 supplies the start instruction to the position information outputter 102 and ending at the time point at which the overall control device 100 supplies travel start instruction to the first traveling object 10, three traveling objects 10 (10A, 10B, and 10C) corresponding to three model horses 4 are in the stopping state. The length of the preparation period is set to be longer enough than the scanning period (cycle period) of the position information outputter 102 (10 milliseconds). In this embodiment, since the position information outputter 102 acquires the position information of each detected piece 108 at every 10 milliseconds to supply it to the overall control device 100, if the length of the preparation period is set to be longer than 10 milliseconds, the position information outputter 102 can reliably obtain the position information of each detected piece 108 in the preparation period, i.e., the position information of each detected piece 108 in the stopping state when the traveling objects 10A, 10B, and 10C stop. Then, the position information outputter 102 supplies the position information of each detected piece 108 to the overall control device 100. The position information of each detected piece 108 supplied from the position information outputter 102 is stored in the memory (not shown).

Figure 11:
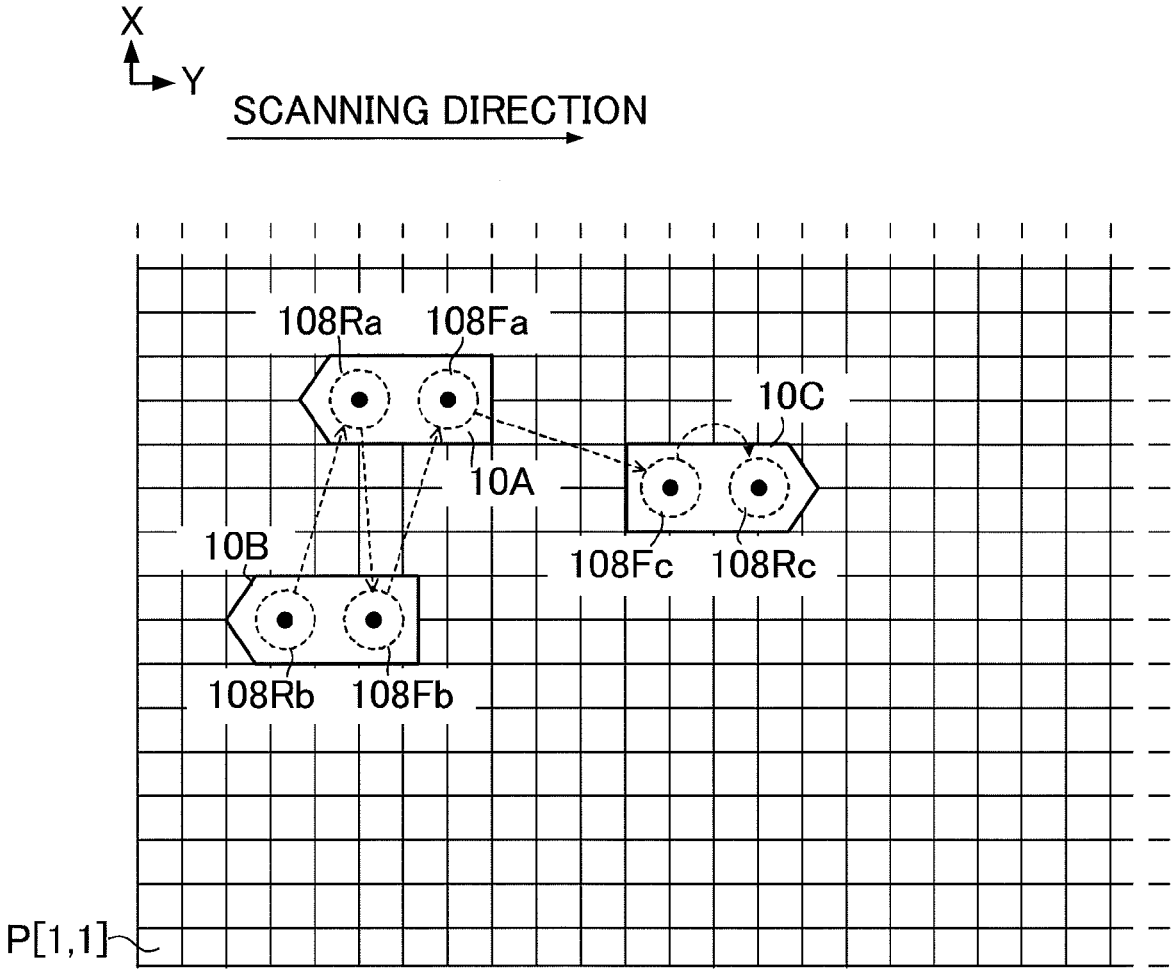
FIG. 11 is a view showing locations of self-propelled carriers (traveling objects) at a preparation period in the determination process.

FIG. 11 is a view showing locations of traveling objects 10A, 10B, and 10C at the preparation period. The black circles in FIG. 11 indicate the center positions of detected pieces 108 corresponding to the position information. Squares in FIG. 11 indicate the cells P; for example, the square on the bottom-left corner in FIG. 11 is the cell P[1, 1] arranged at the intersection of the driving coil 130 of the first row and the detected coil 132 of the first column Among a pair of detected pieces 108 on the traveling object 10A, the detected piece 108 at the side of the advancing direction is referred to as the detected piece 108Fa, whereas the detected piece 108 at the side of the rearward movement direction is referred to as the detected piece 108Ra. Among a pair of detected pieces 108 on the traveling object 10B, the detected piece 108 at the side of the advancing direction is referred to as the detected piece 108Fb, whereas the detected piece 108 at the side of the rearward movement direction is referred to as the detected piece 108Rb. Among a pair of detected pieces 108 on the traveling object 10C, the detected piece 108 at the side of the advancing direction is referred to as the detected piece 108Fc, whereas the detected piece 108 at the side of the rearward movement direction is referred to as the detected piece 108Rc. As shown in FIG. 11, the scanning direction (the direction of driving m driving coils 130 sequentially) is the positive Y direction (see also FIGS. 7 and 8), so that in the scanning of one time, the detection values d of each detected pieces 108 are sought in the order from the detected piece 108Rb, then the detected piece 108Ra, then the detected piece 108Fb, then the detected piece 108Fa, then the detected piece 108Fc, and then the detected piece 108Rc. Thus, the position information outputter 102 repeats supplying the position information of each detected piece 108 to overall control device 100 by repetition of scanning.

Figure 12:
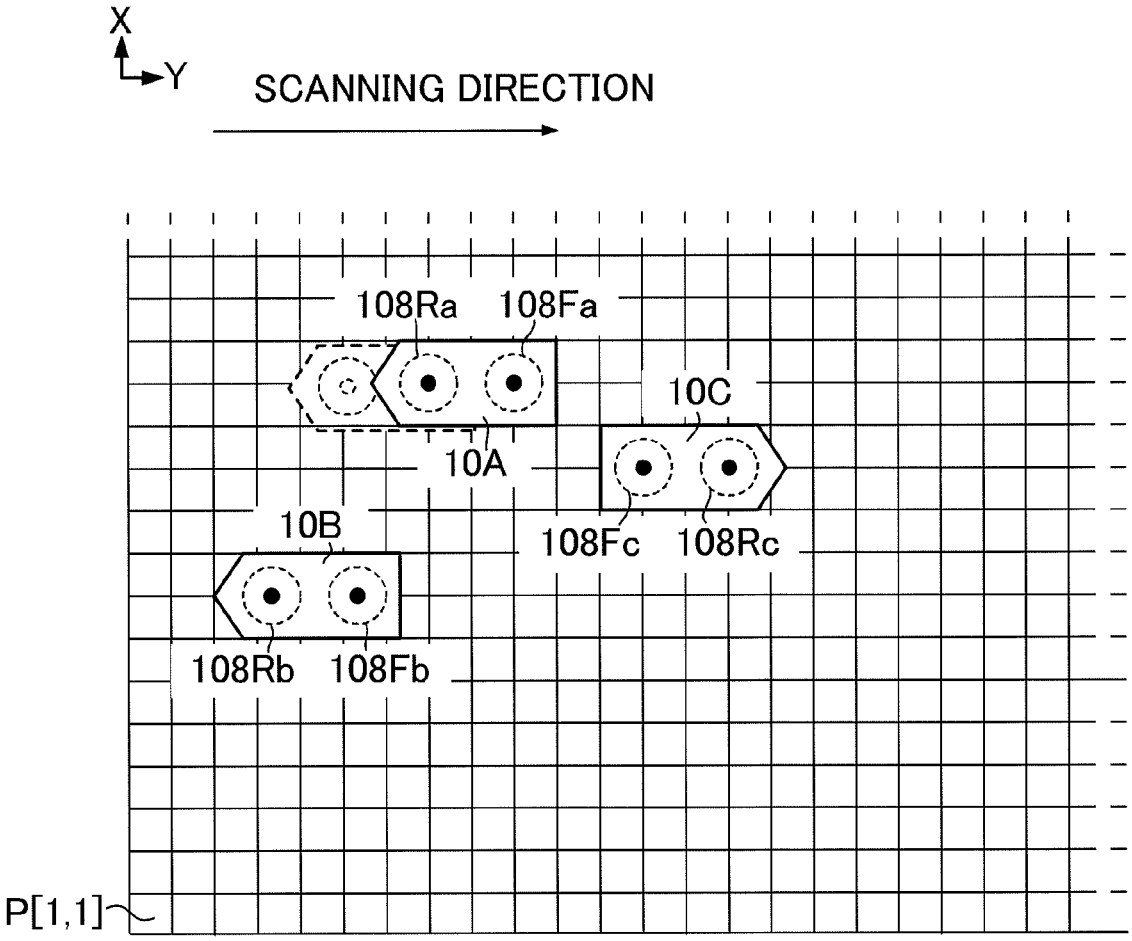
FIG. 12 is a view showing locations of traveling objects when a traveling object advances for a predetermined period and stops.

Referring again to the flowchart of FIG. 10, description will be continued. After step S1, the overall control device 100 supplies traveling control signals sequentially to the traveling objects 10A, 10B, and 10C, each traveling control signal instructing the traveling object 10 corresponding to the traveling control signal to advance for a predetermined period (or by a movement amount) in order to cause the traveling objects 10 to move individually (step S2). In this embodiment, the overall control device 100 outputs the traveling control signals in the order from the signal for the traveling object 10A, then the signal for the traveling object 10B, and then the signal for the traveling object 10C. First, the overall control device 100 outputs the traveling control signal to instruct the traveling object 10A to advance for the predetermined period. The CPU 114 of the traveling object 10A controls both wheel motors 28 in accordance with the traveling control signal sent from the second light emitting device 106. FIG. 12 is a view showing locations of traveling objects 10A, 10B, and 10C when a traveling object 10A advances for the predetermined period and stops. As will be understood from FIGS. 11 and 12, in this case, the position information (more specifically, the central coordinates) of two detected pieces 108Fa and 108Ra among six detected pieces 108Fa, 108Ra, 108Fb, 108Rb, 108Fc, and 108Rc, changes.

After step S2, the overall control device 100 reads from the memory (not shown) the position information of each detected piece 108 output from the position information outputter 102 after supplying the travel control signal and the position information of each detected piece 108 output from the position information outputter 102 directly before supplying the travel control signal, and executes the comparison process for comparing the former position information and the present position information (step S3).

After step S3, the overall control device 100 conducts a first determination, a second determination, and a third determination (step S4). In the first determination, the overall control device 100 determines whether or not the position information on two detected pieces 108 has changed. In the second determination, the overall control device 100 determines whether or not the vectors of traveling directions of the two detected pieces 108 of which the position information has changed are the same as each other. In the third determination, the overall control device 100 determines whether or not the interval between the two detected pieces 108 of which the position information has changed is the same as the predetermined interval. Then, the overall control device 100 determines whether or not all of results of the first to third determinations are affirmative (step S5). Here, the position information of the two detected pieces 108Fa and 108Ra at the traveling object 10A will change. Therefore, the result of the first determination is affirmative. In addition, the vectors of traveling directions of the detected piece 108Fa and 108Ra are the same as each other, so that the result of the second determination is also affirmative. Furthermore, the interval between the two detected pieces 108Fa and 108Ra of which the position information (the distance along the Y direction in FIGS. 11 and 12) has changed is equal to the predetermined interval, so that the result of the third determination is also affirmative. Therefore, all of results of the first to third determinations are affirmative.

If all of results of the first to third determinations are affirmative, the overall control device 100 determines the two detected pieces 108 of which the position information has changed as the two detected pieces 108 corresponding to the traveling object 10 that has moved in response to the traveling control signal (step S6). In other words, from the position information that changes due to the instruction for advancing, two detected pieces 108 are specified as the detected piece 108Fa at the side of the advancing direction of the traveling object 10A and the detected piece 108Ra at the side of the rearward movement direction of the traveling object 10A. Then, the overall control device 100 stores into the memory (not shown) the position information of the two detected pieces 108Fa and 108Ra in such a manner that the position information of the two detected pieces 108Fa and 108Ra is associated with the identifier of the traveling object 10A. On the other hand, if the result of step S5 is negative, the process returns to step S2. In this case, the overall control device 100 outputs the traveling control signal for the traveling object 10A to advance for the predetermined period again, and repeats steps S3 to S5. If the number of repetition reaches a predetermined number but the result of step S5 is not affirmative, the overall control device 100 determines that the traveling object 10A is in failure, interrupts the determination process, and conducts a predetermined error process. Alternatively, if the number of repetition reaches a predetermined number but the result of step S5 is not affirmative, the overall control device 100 may record that the traveling object 10A is in failure, may skip step S5, and may conduct the predetermined error process if the traveling object 10A is still in failure even after the end of the determination process. An example of failure of the traveling object 10A is a status in which a screw for fixing one of the detected pieces 108 is loosened, and thereby the detected piece 108 is detached.

After step S6, the overall control device 100 determines whether or not the two detected pieces 108 corresponding to each of the traveling objects 10A, 10B, and 10C have been determined (step S7). If the result of step S7 is negative, the process returns to step S2 to continue the determination process. Here, two detected pieces 108 corresponding to each of the traveling objects 10B and 10C have not been determined, the result of step S7 is negative, so that the process returns to step S2. At step S2 of this time, the overall control device 100 outputs the traveling control signal for the second traveling object 10B to advance for the predetermined period. Afterward, step S3 and the subsequent steps are the same as those described above, whereby two detected pieces 108Fb and 108Rb corresponding to the traveling object 10B are identified. Similarly, two detected pieces 108Fc and 108Rc corresponding to the traveling object 10C are also identified. By completion of determination of two detected pieces 108 corresponding to each of the traveling object 10A, 10B, and 10C, when the result of step S7 is affirmative, the determination process ends. Afterward, the overall control device 100 tracks the position information of two detected pieces 108 corresponding to each of multiple traveling objects 10A, 10B, and 10C, thereby tracking the position information of each of the traveling objects 10A, 10B, and 10C. In this embodiment, since two detected pieces 108 are provided to each of the multiple traveling objects 10A, 10B, and 10C and are spaced apart from each other by the predetermined interval, it is possible to accurately identify the direction of travel of each of the traveling objects 10A, 10B, and 10C in comparison with a case in which only a single detected piece 108 is provided to each traveling object 10.

If there is an unusual object of a metal material on the second floor panel 6, the position information outputter 102 will output position information that does not correspond to any of the traveling objects 10A, 10B, and 10C. If there is position information that does not correspond to any of the traveling objects after the end of the determination process, it is determined that there is an unusual object or something and an error alarm is made. In other words, the overall control device 100 (determiner) makes an instruction of error notification if the device 100 determines that there is position information that does not correspond to any of the traveling objects after determining two detected objects corresponding to each of the multiple self-propelled carriers (traveling objects). The error is notified to outside via a display device of the game apparatus 1 or communication.

As has been described above, in the determination period, whenever the overall control device 100 outputs the traveling control signal for each of the traveling objects 10A, 10B, and 10C to advance for the predetermined period (whenever the overall control device 100 outputs travel start instruction), the overall control device 100 conducts the comparison process for comparing the position information of each detected piece 108 output from the position information outputter 102 before supplying the travel start instruction with the position information of each detected piece 108 output from the position information outputter 102 after supplying the travel start instruction, and conducts the first to third determinations. If all of the results of the first to third determinations are affirmative, the overall control device 100 identifies the detected pieces 108 of which position information has changed as the two detected pieces 108 corresponding to the traveling object 10 that has traveled in response to the traveling control signal. Accordingly, if the position information of each detected piece 108 cannot be obtained individually, advantageously, it is possible to determine two detected pieces 108 corresponding to the traveling object 10 accurately and easily.

4. Variations

The above-described embodiment can be modified in various ways.

Specific variations will be exemplified below. Any of two or more selected from among the following variations can be combined.

(1) Variation 1

In the above-described embodiment, two detected pieces 108 are provided on each of multiple traveling objects 10. However, the present invention is not limited to this, and rather, only a single detected piece 108 may be provided on each of the multiple traveling objects 10. In this variation, in the determination period, whenever the overall control device 100 outputs the traveling control signal for each of the traveling objects 10 to advance for the predetermined period, the overall control device 100 conducts the comparison process for comparing the position information of each detected piece 108 before supplying the traveling control signal with the position information of each detected piece 108 after supplying the traveling control signal, and identifies the detected piece 108 of which position information has changed as the detected piece 108 corresponding to the traveling object 10 that has traveled in response to the traveling control signal. Accordingly, even if information on the position of each detected piece 108 cannot be obtained individually, it is possible to determine accurately and easily the detected piece 108 corresponding to each traveling object.

(2) Variation 2

In the above-described embodiment, in the determination period, the overall control device 100 executes the determination process, whereas the traveling objects 10 are moved individually. However, the present invention is not limited to this, and rather, the overall control device 100 can identify the two detected pieces 108 corresponding to a traveling object 10, whereas another traveling object 10 of which the two detected pieces 108 have been already identified is continuously being moved. Details of this variation are as follows.

Figure 13:
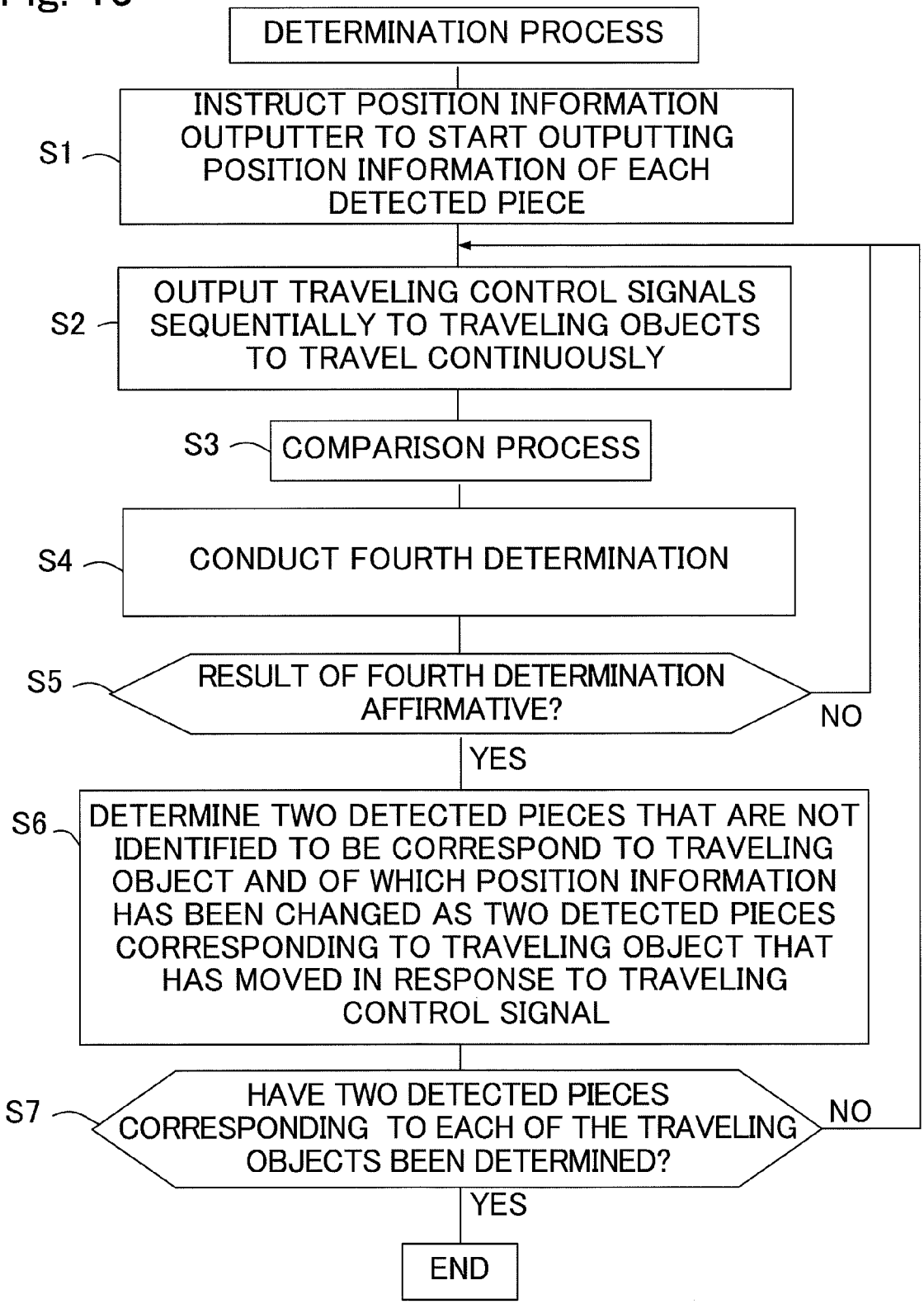
FIG. 13 is a flowchart showing details of a determination process executed in another game apparatus according to a variation of the present invention.

FIG. 13 is a flowchart showing details of the determination process executed in this variation. In the following, features different from the above embodiment will be mainly described. At step S2 in FIG. 13, the overall control device 100 supplies traveling control signals sequentially to the traveling objects 10A, 10B, and 10C, each traveling control signal instructing the traveling object 10 corresponding to the traveling control signal to travel continuously in order to cause the traveling objects 10 to run continuously. In this variation, the overall control device 100 outputs the traveling control signals in the order from the signal for the traveling object 10A, then the signal for the traveling object 10B, and then the signal for the traveling object 10C. First, the overall control device 100 outputs the traveling control signal for the first traveling object 10A to continuously travel. In accordance with the traveling control signal sent from the second light emitting device 106, the CPU 114 of the traveling object 10A controls both wheel motors 28. The comparison process at step S3 after step S2 is the same as that in the above-described embodiment, so that the description thereof is omitted.

After step S3, the overall control device 100 conducts a fourth determination in which the overall control device 100 determines whether or not there are two detected pieces 108 that are not identified to correspond to a traveling object 10 and of which the position information has been changed (step S4). Then, the overall control device 100 determines whether or not the result of the fourth determination is affirmative. Here, none of the six detected pieces 108 are identified to correspond to traveling objects 10, and position information of two detected pieces 108Fa and 108Ra has changed. Therefore, the result of the fourth determination is affirmative. If the result of the first determination is affirmative, the overall control device 100 determines the two detected pieces 108 as the two detected pieces 108 corresponding to the traveling object 10 that has traveled in response to the traveling control signal (step S6). Consequently, the detected piece 108Fa and 108Ra are identified as the two detected pieces 108 corresponding to the traveling object 10A that has traveled in response to the traveling control signal.

After step S6, the overall control device 100 determines whether or not the two detected pieces 108 corresponding to each of the traveling objects 10 have been determined (step S7). If the result of step S7 is negative, the process returns to step S2 to continue the determination process. Here, two detected pieces 108 corresponding to each of the traveling objects 10B and 10C have not been determined, the result of step S7 is negative, so that the process returns to step S2. At step S2 at this time, the overall control device 100 outputs the traveling control signal for the second traveling object 10B to travel continuously. Accordingly, the traveling object 10B starts continuous traveling. The traveling object 10A of which the two detected pieces 108 have been already identified is also continuously traveling. At the next comparison process of step S3, the number of detected pieces 108 of which position information has changed is four (detected pieces 108Fa, 108Ra, 108Fb, and 108Rb). However, since two detected pieces 108Fa and 108Ra have been already identified to correspond to the traveling object 10A, the remaining two detected pieces 108Fb and 108Rb are two detected pieces 108 that are not identified to correspond to a traveling object 10 and of which the position information has been changed. Thus, the result of the fourth determination of step S4 is affirmative (step S5), the two detected pieces 108Fb and 108Rb are determined as the two detected pieces 108 corresponding to the traveling object 10B that has traveled in response to the traveling control signal output at last step S2 (step S6). Thereafter, steps S2 to S6 are repeated, so that the two detected pieces 108Fc and 108Rc corresponding to the third traveling object 10C are determined. In this variation, it is possible to determine two detected pieces 108 corresponding to each traveling object 10.

Instead of the fourth determination of step S4 in FIG. 13, it is possible to conduct a fifth determination, a sixth determination, and a seventh determination. In the fifth determination, it is determined whether or not the number of the detected pieces 108 of which the corresponding traveling object 10 has not been identified and of which the position information has changed is two. In the sixth determination, it is determined whether or not the vectors of traveling directions of the two detected pieces 108 of which the corresponding traveling object 10 has not been identified and of which the position information has changed are the same as each other. In the seventh determination, it is determined whether or not the interval between the two detected pieces 108 of which the corresponding traveling object 10 has not been identified and of which the position information has changed is the same as the predetermined interval. If all of results of the fifth to seventh determinations are affirmative, it is possible to identify the two detected pieces 108 as the detected pieces 108 corresponding to the traveling object 10 that has traveled in response to the traveling control signal instructing the continuous traveling. Accordingly, it is possible to determine more accurately the two detected pieces 108 corresponding to the traveling object 10 that has traveled in response to the traveling control signal instructing the continuous traveling.

(3) Variation 3

In the above-described embodiment, the overall control device 100 executes all of the first to the third determinations. However, the overall control device 100 may execute only any one of the first to the third determinations. For example, the overall control device 100 may conduct only the first determination, and may identify the two detected pieces 108 of which the position information has changed as the two detected pieces 108 corresponding to the traveling object 10 that has traveled in response to the traveling control signal if the result of the first determination is affirmative.

The overall control device 100 may determine the two detected pieces 108 of which the position information has changed as the two detected pieces 108 corresponding to the traveling object 10 that has traveled in response to the traveling control signal if the results of two of the first to the third determinations selected optionally are affirmative. For example, the overall control device 100 may execute the first determination and the second determination without executing the third determination, and may determine the two detected pieces 108 of which the position information has changed as the two detected pieces 108 corresponding to the traveling object 10 that has traveled in response to the traveling control signal if the results of the first determination and the second determination are affirmative. In addition, it is possible to combine another determination to the two determinations.

(4) Variation 4

In the game apparatus 1 according to the above-described embodiment, a horse racing game is executed. However, the type of game executed in the game apparatus 1 may be freely decided. For example, a bicycle racing game may be executed in which bicycle models on which bicyclist models ride are pulled by the traveling objects 10. A car racing game may be executed in which racing car models are pulled by the traveling objects 10. Furthermore, it is possible to exclude models pulled by the traveling objects 10 and the floor panel 3, so that the traveling objects 10 themselves may be observed by players. In this case, the type of game executed in the game apparatus 1 may be also freely decided. For example, a car racing game may be executed in which each traveling object 10 is of the shape of a racing car. In summary, the present invention may be applied to any type of driving apparatus for driving multiple traveling objects.

(5) Variation 5

In the above-described embodiment, the position information outputter 102 outputs the position information of each detected piece 108 using electromagnetic couplings. However, for example, a light emitter may be provided to each traveling object, and the position information outputter 102 may output position information of each light emitter on the basis of a shot image of the light emitters. However, in this case, the light emitters on the traveling objects should be simultaneously activated and deactivated or maintained to be always activated. In summary, the position information outputter 102 should be of the type that can output position information of the detected objects provided to the multiple traveling objects 10 simultaneously, but cannot output the position information of the detected objects individually.

Reference Symbols

1: Game Apparatus (Driving Apparatus for Traveling Objects)
2: Column
2*a*: Frame
3: Floor Panel
4: Model Horse
5: Electric Charging Apparatus
6: The Second Floor Panel
10: Traveling Object
20: Caster
22: Wheel
26: Driving Wheel
28: Wheel Motor
30: Electric Power Source Assembly
40: Model Assembly
100: Overall Control Device (Traveling Controller)
102: Position Information Outputter
104: First Light Emitting Device
106: Second Light Emitting Device
108: Detected Piece (Detected Objects)
110: First Optical Sensor
112: Second Optical Sensor
130: Driving Coils (Driving Lines)
132: Detected Coils (Detected Lines)
140: Cell Part
150: Driving Circuit
160: Detection Circuit
170: Processing Circuit
$I_d$: Driving Current
$I_t$: Induced Current
Lds: Position Detective Sheet
P: Cell
SEL: Operational signal
SW: Switch
T: Unit Period
$V_{SYNC}$: Timing Signal

What is claimed is:

1. A driving apparatus for traveling objects for causing multiple traveling objects to travel on a traveling surface, comprising:

a traveling controller adapted for controlling travel of each of the multiple traveling objects, two detected objects provided to each traveling object, the two detected objects spaced apart from each other by a predetermined interval on the corresponding traveling object;

a position information outputter adapted for outputting position information on each of the multiple detected objects on the traveling surface; and a determiner adapted for identifying two detected objects corresponding to each of the multiple traveling objects on the basis of the position information on each of the multiple detected objects output from the position information outputter, wherein the traveling controller is adapted for supplying a travel start instruction to each of the multiple traveling objects sequentially during a determination period for determining two detected objects corresponding to a traveling object, wherein the determiner is adapted for conducting a comparison process whenever the traveling controller supplies the travel start instruction, in the comparison process, the determiner is adapted for comparing the position information of each detected object output from the position information outputter before supplying the travel start instruction with the position information of each detected object output from the position information outputter after supplying the travel start instruction, and wherein the determiner is adapted for identifying two detected objects of which the position information has changed as the two detected objects corresponding to the traveling object that has moved in response to the travel start instruction.

2. The driving apparatus for traveling objects according to claim 1, wherein the determiner is adapted for identifying two detected objects of which the position information has changed as the two detected objects corresponding to the traveling object that has moved in response to the travel start instruction when one of or a combination of any of a first determination, a second determination, and a third determination is affirmative, wherein in the first determination, the determiner is adapted for determining whether or not the position information on two detected objects has changed, wherein in the second determination, the determiner is adapted for determining whether or not vectors of traveling directions of the two detected objects of which the position information has changed are the same as each other, and wherein in the third determination, the determiner is adapted for determining whether or not an interval between the two detected objects of which the position information has changed is the same as the predetermined interval.

3. The driving apparatus for traveling objects according to claim 1, wherein the determiner is adapted for identifying two detected objects that have not been determined to correspond to which traveling object and of which the position information has changed as the two detected objects corresponding to the traveling object that has moved in response to the travel start instruction.

4. The driving apparatus for traveling objects according to claim 1, further comprising a tracker adapted for tracking position information of one or two detected objects corresponding to each of the multiple traveling objects identified by the determiner.

5. The driving apparatus for traveling objects according to claim 1, wherein the detected objects are made of an electric conductor, wherein multiple driving lines and multiple detected lines are arranged to perpendicularly intersect one another on the traveling surface, electromagnetic couplings being made at intersections of the multiple driving lines and multiple detected lines, wherein the position information outputter supplies a driving current to each of the multiple driving lines sequentially, and obtains the position information of each detected object on the basis of a value of an induced current flowing each of the detected lines.

6. A driving apparatus for traveling objects for causing multiple traveling objects to travel on a traveling surface, comprising:

a traveling controller adapted for controlling travel of each of the multiple traveling objects, a detected object provided to each traveling object;

a position information outputter adapted for outputting position information on each of the multiple detected objects on the traveling surface; and a determiner adapted for identifying a detected object corresponding to each of the multiple traveling objects on the basis of the position information on each of the multiple detected objects output from the position information outputter, wherein the traveling controller is adapted for supplying a travel start instruction to each of the multiple traveling objects sequentially during a determination period for determining a detected object corresponding to a traveling object, wherein the determiner is adapted for conducting a comparison process whenever the traveling controller supplies the travel start instruction, in the comparison process, the determiner is adapted for comparing the position information of each detected object output from the position information outputter before supplying the travel start instruction with the position information of each detected object output from the position information outputter after supplying the travel start instruction, and wherein the determiner is adapted for identifying a detected object of which the position information has changed as the detected object corresponding to the traveling object that has moved in response to the travel start instruction.

7. A method for determining two detected objects corresponding to each of multiple traveling objects on the basis of position information on each of the multiple detected objects, the method being used in a driving apparatus adapted for causing the multiple traveling objects to travel on a traveling surface, two detected objects spaced apart from each other by a predetermined interval provided to each traveling object, the method comprising:

supplying a travel start instruction to each of the multiple traveling objects sequentially during a determination period for determining two detected objects corresponding to a traveling object;

comparing the position information of each detected object before supplying the travel start instruction with the position information of each detected object after supplying the travel start instruction whenever travel start instruction is supplied; and identifying two detected objects of which the position information has changed as the two detected objects corresponding to the traveling object that has moved in response to the travel start instruction.

8. A program incorporated into a driving apparatus adapted for causing multiple traveling objects to travel on a traveling surface, two detected objects spaced apart from each other by a predetermined interval provided to each traveling object, the program causes the driving apparatus to conduct:

supplying a travel start instruction to each of the multiple traveling objects sequentially during a determination period for determining two detected objects corresponding to a traveling object;

comparing position information of each detected object on the traveling surface before supplying the travel start instruction with position information of each detected object on the traveling surface after supplying the travel start instruction whenever travel start instruction is supplied; and identifying two detected objects of which the position information has changed as the two detected objects corresponding to the traveling object that has moved in response to the travel start instruction.

* * * * *